US005134736A

United States Patent [19]

Anthony et al.

[11] Patent Number: 5,134,736

[45] Date of Patent: Aug. 4, 1992

[54] BEDDING SHEET ASSEMBLY FOR WATERBED AND OTHER MATTRESSES

[76] Inventors: Patricia A. Anthony; Robert E. Anthony, both of 800 Santa Barbara St. #12, Sanford, Fla. 32773

[21] Appl. No.: 598,212

[22] Filed: Oct. 16, 1990

[51] Int. Cl.[5] ..... A47G 9/02

[52] U.S. Cl. ..... 5/496; 5/497; 5/500

[58] Field of Search ..... 5/494–500, 5/502

[56] References Cited

U.S. PATENT DOCUMENTS

| | | | |
|---|---|---|---|
| 2,789,292 | 5/1955 | Budinquest | 5/494 |
| 3,179,958 | 4/1965 | Carris | 5/496 |
| 3,570,026 | 3/1971 | Allison | 5/496 |
| 4,304,018 | 12/1981 | McClam | 5/494 |
| 4,389,744 | 6/1983 | Monroe | 5/498 |
| 4,899,408 | 2/1990 | Illingworth | 5/497 |
| 4,979,251 | 12/1990 | Lazar | 5/496 |
| 5,003,655 | 4/1991 | Kafai | 5/496 |

*Primary Examiner*—Renee S. Luebke
*Assistant Examiner*—F. Saether
*Attorney, Agent, or Firm*—Edward M. Livingston

[57] ABSTRACT

A bedding sheet assembly, particularly adapted for waterbeds but also usable with other types of mattresses, having a novel mattress belt (1), a first or bottom sheet (2), and a second or top sheet (3). The mattress belt (1) has sides (10) that fit around the perimeter of a mattress (4), a small lip on the bottom (8) to fit under the mattress and a top lip (9) to fit on top of the mattress along its sides. The top lip (9) of the mattress belt contains fastening material (7) for securing the bottom sheet thereto by matching fastening material (17) on the underside of the bottom sheet. A flap (12) attached to the foot end of the mattress belt has fastening material (11) for securing the top sheet (3) thereto. The bottom and top sheets may have ruffled flaps (25 and 18) to fit over the sides of the mattress belt to keep the mattress belt clean and attractive. In this manner the mattress belt does not have to be changed very often, therby allowing sheets to be changed merely by releasably detaching the bottom and top sheets (2 and 3) and quickly fastening new bottom and top sheets thereto. The mattress belt may be provided with one or more triangular release corners (15) to release the pressure when the mattress belt is changed.

8 Claims, 2 Drawing Sheets

BEDDING SHEET ASSEMBLY FOR WATERBED AND OTHER MATTRESSES

BACKGROUND OF THE INVENTION

This invention relates to bedding sheet assemblies and, more particularly, to new bedding sheet components including a novel mattress belt.

Currently, every time the sheets on a bed are changed, the sides and corners of a bed must be lifted to remove the sheets from under the sides of the bed. The requirement to lift up the sides and corners of the bed is even more pronounced in the case of non-fitted sheets, which have to be folded under the mattress a considerable distance in order to secure the sheets in place. Such lifting is a particular problem for the elderly, arthritis sufferers and almost anyone, in the case of waterbeds, which have heavy mattresses when filled with water.

In addition to the difficulty in changing the sheets, the time involved in changing the sheets on a bed is considerable especially when numerous beds are involved, such as in a hotel.

Another problem encountered with current bedsheets is that most sheets, even fitted ones, come off the bed while sleeping because the sheets cannot withstand the weight of a person's body and the stress placed on said sheets. As a result, the bed must be remade and sheets resecured on a continual basis.

Some patented inventions in the prior art have attempted to solve these problems, but none has been successful. For instance, U.S. Pat. No. 4,488,323 by Colburn, dated Dec. 18, 1984, uses fastening material permanently affixed to a mattress and matching fastening material on the sheets is secured thereto. Unfortunately, the Colburn invention requires that a mattress be altered for it to be used. Also in Colburn, the bottom sheet is not sufficiently attached to support the stress of a person sleeping on the bed.

U.S. Pat. No. 3,832,743 by Smith dated Sep. 3, 1974, uses hook and loop fastening material on the sides of a standard bottom sheet to secure the top sheet thereto. Unfortunately, this system requires a standard bottom sheet and one still must lift up the corners and sides of the bed each time the bed is made.

U.S. Pat. No. 4,040,133 by Gilreath dated Aug. 9, 1977, uses only a strip of Velcro fastening material on the corners of the bed to secure the sheets. Unfortunately, Gilreath's invention also is insufficient to withstand the stress placed on the sheets.

U.S. Pat. No. 3,965,504 by Ainsworth, dated Jun. 29, 1976, uses Velcro strips along the edges of sheets and loops around the corner of the bottom sheet for securing the sheet in place. Unfortunately, this system too requires that the sheets be changed. The Ainsworth invention also will not keep sheets on the bed since it cannot take the stress of someone lying on the bed.

U.S. Pat. No. 4,301,561, by McLeod dated Nov. 24, 1981, differs from the present in that it uses a complete underliner with Velcro fastening material on the side to secure the sheets to the bed. Such would require the removal of an entire mattress or, in the case of a waterbed, the draining of water therefrom before replacing the sheet and liner assembly.

U.S. Pat. No. 4,833,744 by Correa dated May 30, 1989, requires a rigid piece to be placed on the corner of the waterbed, said rigid piece having Velcro fastening material to which the sheets are attached. Unfortunately, this system will also not hold the stress placed on the sheets.

U.S. Pat. No. 3,530,487 by Beer dated Sep. 22, 1970, uses zippers to attach the sheets to the side of the mattress and to each other.

Finally, U.S. Pat. No. 4,736,478 by Dangerously, dated Apr. 12, 1988, uses a corner pocket structure to hold the sheets under each corner of a waterbed.

Despite the different attempts to overcome the problems with traditional bedding sheet assemblies, the afore-referenced patented inventions require that the bed mattress still be lifted each time the sheets are changed. Furthermore, most would also require modifications to the standard mattress which would have to be done at the factory or by the consumer after purchase.

On the other hand, the present invention solves the above problems by providing an invention having three major components: (1) A mattress belt fitted around the mattress; (2) a specially designed bottom sheet to fit over the mattress belt; and (3) a top sheet which is secured to the mattress belt and fits over the bottom sheet. The present invention enables one to change bedding sheets merely by detaching the top and bottom sheets in one step by pulling both sheets from the mattress belt. The mattress belt can be used interchangeably with many different sheets for a long period of time through many changes of sheets before washing as only the top sheet and bottom sheet have contact with the body.

SUMMARY OF THE INVENTION

The major object of the present invention is to provide such a bedding sheet assembly that requires less strength to change the sheets because it eliminates the need to lift heavy mattresses, particularly in the case of waterbeds, every time the sheets are changed.

Another object of the present invention is to provide a bedding sheet assembly that makes changing sheets much easier.

A further object of the present invention is to provide a bedding sheet assembly that enables the sheets to remain securely in place by withstanding the stresses applied thereto.

An even further object of the present invention is to provide a bedding sheet assembly that reduces the time it takes one to change bedding sheets.

An additional object of the present invention is to provide a bedding sheet assembly that enables one to change the sheets on a waterbed without having to drain the water from the bed before changing said sheets.

A further object of the present invention is to provide a bedding sheet assembly for use in hospitals and other health care facilities since the taut sheets could reduce bed sores often caused by loose sheets.

An even further object is to increase safety for infants by using the bedding sheet assembly for infant crib sheets.

The present invention accomplishes the above and other objects by providing a bedding sheet assembly comprising three components: (1) a mattress belt which fits around the sides of the mattress, said belt having means thereon for fastening thereto a first bottom sheet; (2) a first bottom sheet having matching fastening means to the mattress belt; and (3) a second top sheet adapted in size to fit over the first bottom sheet. The mattress belt is also provided with a flap extending from the foot end thereof which acts as a covering over the feet of the user and contains fastening means to which the second sheet can be secured. Although the fastening means may take various forms, the preferable fastening means form would be a hook and loop fastening material such as Velcro fastening material. To help alleviate some of the difficulty in placing the mattress belt around the circumference of the mattress, a triangular-shaped piece with fastening means in at least one corner of the mattress belt is provided which enables one to place it on the mattress with ease and then to secure same after the mattress belt is placed on the bed.

The above and other objects of the present invention will become more readily apparent from the detailed description thereof hereinbelow when taken in conjunction with the drawings.

BRIEF DESCRIPTION OF THE DRAWINGS

This invention is described by claims in relation to a description of preferred embodiments illustrated in the following drawings in which:

DESCRIPTION OF THE PREFERRED EMBODIMENT

Figure 1:
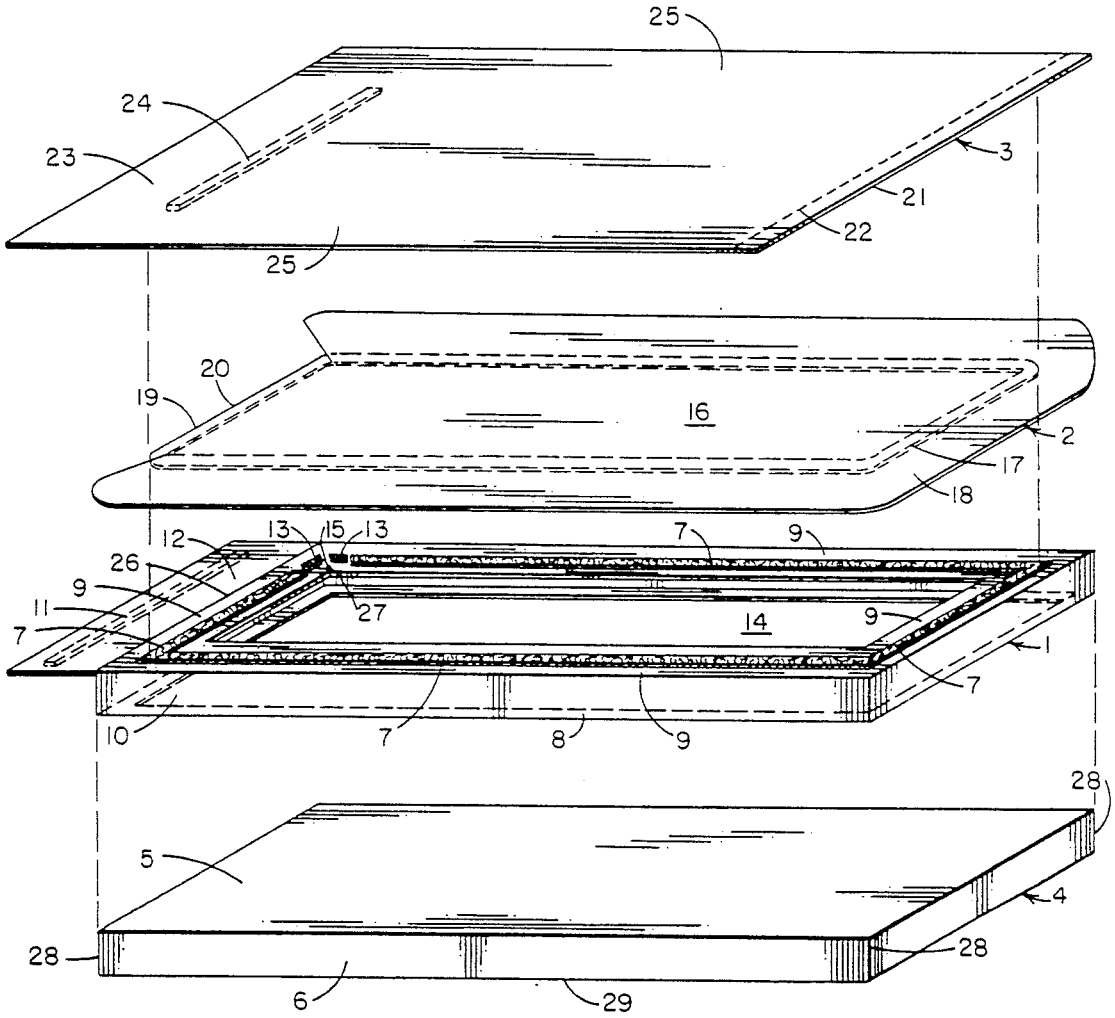
FIG. 1. is a exploded plan view of the bedding sheet assembly.

Referring now the drawings, in FIG. 1 shows a mattress 4 having a flat top surface 5, sides 6, corners 28 and bottom 29. The three major components of the invention are shown above the mattress, those components comprising a mattress belt 1, a first or bottom sheet 2, and a second or top sheet 3.

The mattress belt 1 has a bottom lip 8 and a top lip 9 around all sides of the mattress belt. The top lip 9 contains fastening means 7 around all sides thereof, said fastening means consisting preferably of strips of hook and loop fastening material such as Velcro fastening material. Examples of other fastening means which may be used include snaps or zippers.

In one corner of the mattress belt 1 is a triangular-shaped release corner 15 which enables one to place the mattress belt 1 around the mattress 4 with ease. The release corner 15 contains extra sheet material which enable the mattress belt 1 to be placed easily around the mattress 4. This triangular corner 15 has two opposing strips of fastening material 13 which are fastened to each other to tighten the mattress belt 1 and secure it to the corners 28 of the mattress 4. To remove the belt 1, one merely disconnects the strips of fastening material 13 which loosens the belt 1 for easy removal. Although only one triangular release corner is shown, additional release corners may be used on the mattress belt 1.

At the foot end of the mattress belt 1, is a flap 12 which contains fastening material 11 on the bottom thereof, also preferably consisting of hook and loop fastening material such as Velcro. Although the mattress belt 1 preferably has no top surface 14, since that is provided by the first or bottom sheet 2 described hereinafter, the mattress belt could have a top or even a bottom surface if desired.

The second component of the bedding sheet assembly shown in FIG. 1 is the first or bottom sheet 2 which is secured to the mattress belt 1 by placing said bottom attachment lip 19 so that the fastening material 17 around the circumference of the bottom sheet 2 attaches to the fastening material 7 on the attachment lip 19. Unlike the mattress belt 1 as shown, the bottom sheet 2 has a full top surface 16. This bottom sheet 2 contains flaps or ruffles 18 which are designed to lie over and cover the sides 10 of the mattress belt 1, which keeps the sides 10 of the mattress belt from exposure to dust and the body. Thus, the mattress belt does not have to be changed as often as the bottom and top sheets 2 and 3, respectively.

The final component of the present invention is the top sheet 3 which is placed over the bottom sheet 2. The top sheet 3 contains fastening material 24 which secures the fastening material 11 on the underside of the flap 12 of the mattress belt 1 when said flap 12 is folded over the bottom attachment lip 19 of the bottom sheet 2. In this manner, not only is the top sheet 3 secured to the flap 12 of the mattress belt 1, but the flap 12 also keeps the feet of the user covered by preventing them from extending outside the bottom of the top sheet 3.The top sheet 3 also has bottom flap or ruffle 23 that folds down over the side of the mattress 4 and side flaps or ruffles 25 to also fold over the sides 10 of the mattress belt 1. As shown, the head end of the top sheet 21 has a stitch line 22 on the top thereof.

Figure 2:
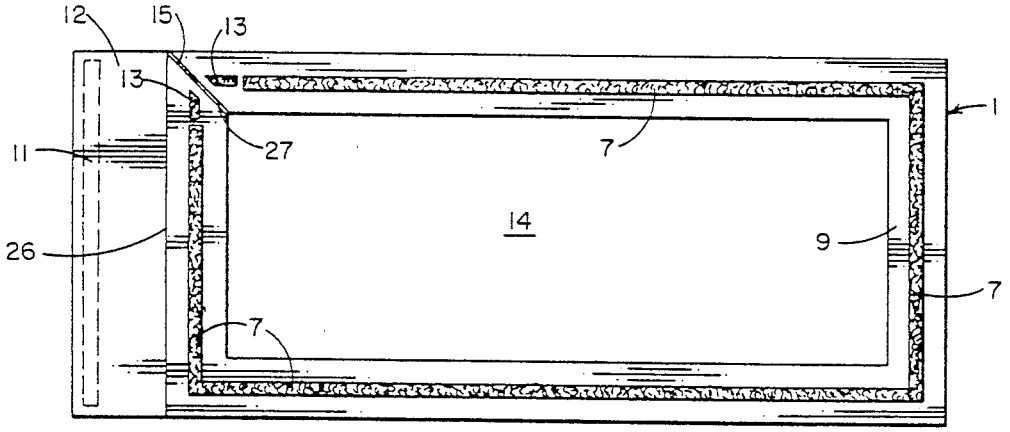
FIG. 2 is a top plan view of the mattress belt of the invention.

Referring now to FIG. 2, a top plan view of the mattress belt 1 is illustrated. The same components of the mattress belt 1 as described in FIG. 1 are evident. The top lip 9 contains the strips of fastening material 7 on the top thereof. At one corner is the release corner 15 which contains the triangular corner fold 27 consisting of two opposing strips of cloth containing matching fastening material which are unfastened when the mattress belt 1 is placed around the mattress 4 more easily. Once the mattress belt 1 is on the mattress 4, then the strips of fastening material 13 in the corner 15 may be secured thereby to tighten the mattress belt 1 on the mattress 4. The flap 12 is shown again with the fastening material 11 beneath it, the bottom flap 12 being secured to the mattress 4 along the foot end 26 by stitching.

Figure 3:
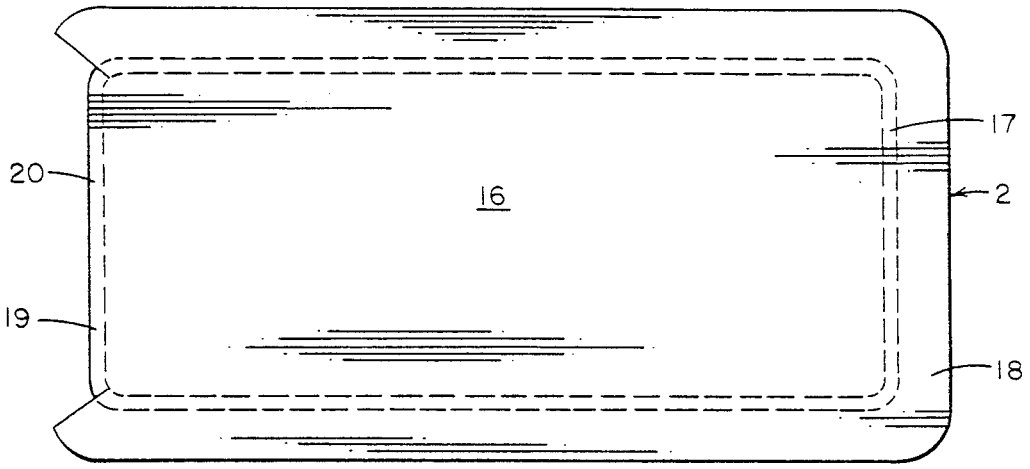
FIG. 3 is a top plan view of the first or bottom sheet of the invention.

FIG. 3 shows the first or bottom sheet 2. The bottom sheet 2 contains a top surface 16 surrounded on its perimeter by an attachment lip 17 on the top and sides thereof and an attachment lip 19, said attachment lips having fastening means beneath them for securing them to the fastening means 7 of the mattress belt 1. The bottom sheet 2 also has a flap or ruffles 18 which extend around the top and two sides thereof so that it falls over the sides 10 of the mattress belt 1 when placed thereover. The bottom attachment lip 19 has no flaps or ruffles on it to allow the flap 12 on the mattress belt 1 to fold up over the lip 19 for attachment to the strip of fastening material 24 on the top sheet 3 as shown in FIG. 4.

Figure 4:
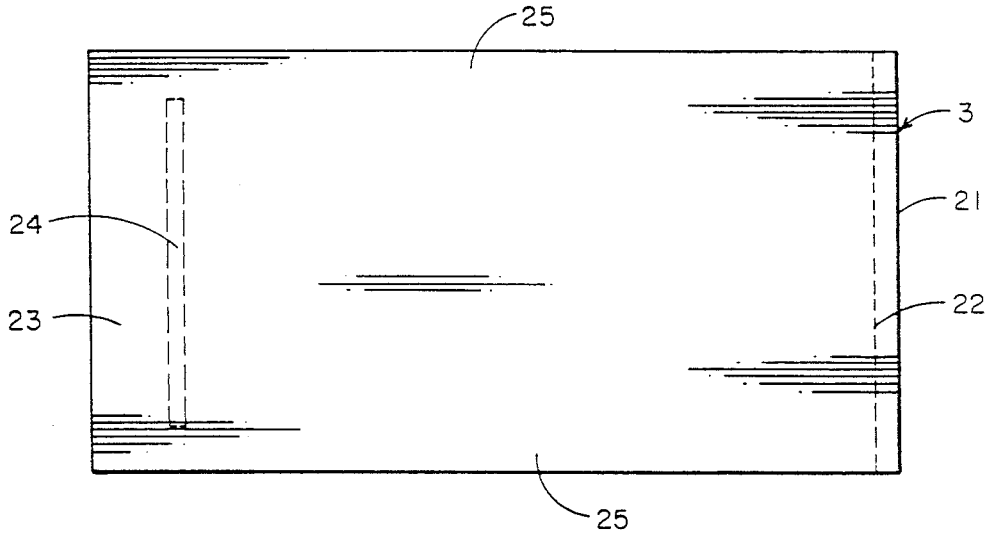
FIG. 4 is a top plan view of the second or top sheet of the invention.
Figure 5:
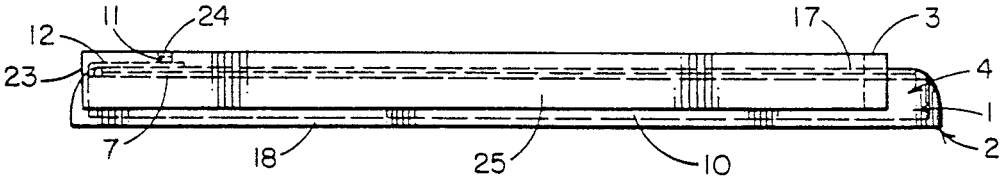
FIG. 5 is an enlarged side plan view of the entire bed sheet assembly appearing on a mattress.

FIG. 4 shows the final component of the invention, the second or top sheet 3. This top sheet 3 has side flaps or ruffles on each side and a flap or ruffle on the foot end 23 thereof. Under the foot end 23 is a strip of fastening material 4 to secure to the fastening material 11 on underside of the flap 12 of the mattress belt 1. The head end 21 of the top sheet 3 can be denoted by the standard stitch line 22. The final illustration in FIG. 5 shows the entire bedding sheet assembly as it would appear on a mattress 4. The mattress belt 1 wraps around the sides 10 of the mattress 4, said mattress belt 1 containing fastening material 7 on the top thereof. The first or bottom sheet 2 is then shown having its fastening material 17 secured to fastening material 7. The flaps 23 droop over the sides of the mattress belt 1. The top sheet 3 is attached to the fastening material 11 on the flap 12 of the mattress belt 1 to secure it in place.

From the description of the preferred embodiments, numerous advantages of the present invention should be apparent, including increased ease and speed in changing the bedding sheets of waterbeds or any bed, better securing of bedding sheets to a bed and elimination of the need to lift the sides and corners of a bed whenever the bed is made. This invention provides a novel and non-obvious bedding sheet assembly which will revolutionize the bedding assemblies of not only waterbeds, but all beds.

Although preferred and optional embodiments of the present invention have been discussed in detail, it should be understood that various modifications are covered as part of this invention within the scope of the claims.

I claim:

1. A bedding sheet assembly comprising:

a mattress belt with adapting means for fitting said mattress belt around the sides and over the edges of a mattress to form a lip around a periphery of a top panel of the mattress' said lip having fastening means on the top thereof for attaching a sheet thereto, said mattress belt also having a flap extending from a foot end thereof, said flap having fastening means for attachment of a sheet;

a first sheet having matching fastening means for attachment to the fastening means on the lip of the mattress belt; and a second sheet adapted and sized to fit over said first sheet, said second sheet having fastening means under a foot end thereof for attachment to the fastening means on the flap.

2. The bedding sheet assembly of claim 1 wherein the means for adapting the mattress belt for fitting around the sides of a mattress comprises two triangular-shaped flaps in one or more corners of said mattress belt, said triangular-shaped flaps providing means for releasing pressure whenever the mattress belt is being placed on the mattress or being removed therefrom, said means consisting of matching fastening material on each flap which is connected to each other to tighten the mattress belt.

3. The bedding sheet assembly of claim 2 wherein the fastening means consist of hook and loop fastening material.

4. The bedding sheet assembly of claim 2 wherein the fastening means consist of snaps.

5. A bedding sheet assembly comprising:

a mattress belt with adapting means for fitting said mattress belt around the sides of a mattress, said mattress belt having a top surface thereon and a flap extending from a foot end of the mattress belt, said flap having fastening means on an underside thereof for attachment of a sheet; and a sheet for placement over the mattress belt, said sheet having a fastening means on an underside of a foot end thereof for attachment to the fastening means on the flap.

6. The bedding sheet assembly of claim 5 wherein the fastening means comprise hook and loop fastening material.

7. The bedding sheet assembly of claim 5 wherein the fastening means consist of snaps.

8. A bedding sheet assembly comprising:

a mattress belt adapted for fitting around the perimeter of a mattress, said mattress belt having sides thereon, each of said sides having a bottom lip attached perpendicularly and fitting under the sides of said mattress and a top lip to fit partially over a top surface of a mattress, said top lip having fastening material thereon for attaching a second sheet thereto, said mattress belt having a release corner comprising two triangular pieces of material for securing to each other to tighten the mattress belt on said mattress and release pressure when the mattress belt is being placed on or being removed from said mattress, said mattress belt further having a flap extending from a foot end of the mattress belt, said flap having fastening material on a bottom side thereof;

a first bottom sheet having a top surface thereon having a lip around the perimeter thereof with fastening material on the bottom of said lip thereof for attaching said lip to the fastening material on the mattress belt; and the second sheet sized to fit over the first sheet with second sheet having fastening material on a foot end thereof for securing same to the fastening material on the flap of the mattress belt, said top sheet also having excess material on the bottom and sides thereof for covering the sides of the mattress belt.

* * * * *